US005299500A

United States Patent [19]

Lindquist et al.

[11] Patent Number: 5,299,500

[45] Date of Patent: Apr. 5, 1994

[54] CONNECTING BLOCK FOR IGNITION DEVICES

[75] Inventors: Vidon Lindquist; Lars-Gunnar Löfgren, both of Nora; Tord Olsson, Gyttorp; Allan Salåker; Bengt Wahlqvist, both of Vikmanshyttan, all of Sweden

[73] Assignee: Nitro Nobel AB, Nora, Sweden

[21] Appl. No.: 835,384

[22] Filed: Feb. 14, 1992

[30] Foreign Application Priority Data

Feb. 18, 1991 [SE] Sweden ..... 9100475
May 31, 1991 [SE] Sweden ..... 9101684

[51] Int. Cl.[5] ..... C06C 5/04; F42B 3/10

[52] U.S. Cl. ..... 102/275.12; 102/275.6; 102/275.7

[58] Field of Search ..... 102/275.12, 275.2, 275.3, 102/275.4, 275.5, 275.6, 275.7

[56] References Cited

U.S. PATENT DOCUMENTS

| | | | |
|---|---|---|---|
| 815,212 | 3/1906 | Powell | 102/293 |
| 2,587,694 | 3/1952 | Chalmers et al. | 102/275.4 |
| 2,952,206 | 9/1960 | Becksted | 102/275.7 |
| 3,320,882 | 5/1967 | Schulz | 102/275.8 |
| 3,455,242 | 7/1969 | Slawinski | 102/275.12 |
| 4,167,139 | 9/1979 | Gleason et al. | 102/313 |
| 4,187,780 | 2/1980 | Potrucelli | 102/275.12 |
| 4,527,482 | 7/1985 | Hynes | 102/275.2 |
| 4,635,734 | 1/1987 | Donovan et al. | 102/312 |
| 4,714,017 | 12/1987 | Kelly et al. | 102/275.6 |
| 4,730,560 | 3/1988 | Bartholomew et al. | 102/275.12 |
| 4,815,382 | 3/1989 | Yunan | 102/275.12 |
| 4,821,645 | 4/1989 | Reiss | 102/275.12 |
| 4,987,818 | 1/1991 | Alford | 102/307 |

FOREIGN PATENT DOCUMENTS

| | | |
|---|---|---|
| 0385614 | 9/1990 | European Pat. Off. . |
| 3123250 | 12/1988 | Fed. Rep. of Germany . |
| 554773 | 6/1923 | France . |
| 1252698 | 12/1960 | France . |
| 1279374 | 11/1961 | France . |

*Primary Examiner*—David H. Brown
*Attorney, Agent, or Firm*—Burns, Doane, Swecker & Mathis

[57] ABSTRACT

A block for enclosing, holding or connecting in a signalling pyrotecnical network exploding pyrotecnic ignition devices, such as cords or detonators. The block comprises, in sequence from a centrally arranged ignition device (9), an inner wall (2) substantially surrounding at least an axial part of the ignition device, an empty space (7), or a material of lower density than in the inner wall, substantially surrounding the inner wall, an outer wall (1) substantially surrounding the inner wall and the space and fixation means (6, 8, 12) for keeping the ignition device, the walls and space in said positions. The block may have an annular inner space (65) or channel spaces between the ignition device and the inner wall and fixation means (35,66,69) for keeping the ignition device, the walls and space in the stated positions, whereby the inner wall is axially slitted (33,64).

42 Claims, 7 Drawing Sheets

CONNECTING BLOCK FOR IGNITION DEVICES

TECHNICAL FIELD

The present invention relates to a block for enclosing, holding or connecting in a signalling pryrotecnic network exploding pyrotecnic ignition devices, such as cords or detonators. In particular the invention relates to a connecting block for initiation of low energy fuses.

BACKGROUND

Ignition devices used for hooking up blasting salvo networks commonly include signalling means in the form of electrical wires, fuses or detonating cords in addition to activation means such as caps or detonators. The surface parts of the network in particular are vulnerable to damages before and during system activation. Ignition failures may result in explosive and sharp detonators remaining in the blasted rock mass. Signalling means of pyrotechnic nature poses special safety problems on the design as explosive system components make the network potentially self-destructive. The full lengths of detonating cords must be carefully positioned and connected to avoid self-cutting or damage on neighboring lines. Low energy fuses are commonly ended with explosive transmission or delay caps which may be destructive both by direct explosive shock and by the action of splinters from its metal parts. Blocks and fixtures are frequently used to securely enclose, position and in particular to connect and branch the various network parts. Block connections may be used both purely between fuses, such as between a primary detonating cord and secondary cords or fuses, and between transmission or delay caps and outgoing fuses or cords. Properly designed, connecting blocks may reduce the destructive action of explosives by aligning fuses, by absorbing or directing the explosive shock and by catching splinters. Improperly designed, the blocks may add to the problems by misaligning the components, by amplifying the explosion through confinement and by itself being the source of shrapnel parts.

Hence, suitable block characteristics means partly contradictory requirements. Although a limited explosive action is desirable to avoid the problems outlined, a sufficiently strong action is needed to secure signal transmission to the secondary ignition devices, which for safety reasons always are made insensitive. Good construction against internal damage must not interfere with maintained good properties against external damage from vehicles, falling rocks etc. on the site. Practical considerations place further constraints on the design. The device is used once which excludes massive, elaborate or otherwise expensive constructions. Connections are made in the field and any feature conditioned by safety must still allow connections to be made easily, reproducibly and without extensive requirements for skill. In manufacture the block must allow rational manual or machine assemby with various kinds of permanent ignition devices.

THE INVENTION IN GENERAL

A main object of the present invention is to provide a block for explosive ignition devices with improved safety against self-destruction in the network. A more specific object is to reduce the action of explosion, splinters and shrapnel. Another object is to provide a block with reliable signal transmission. A further object is to provide a block of simple and non-expensive design. Still another object is to provide a design easily manufactured and plant-assembled with its permanent ignition devices. Yet another object is to provide a block which 4-s versatile and adaptable to various ignition devices. A final object is to offer a block which is easily connected under field conditions to give reproducible coupling results.

These objects are reached by the characteristics set forth in the appended claims.

A block is provided in which a central ignition device is surrounded by an inner wall, a space and an outer wall. For a given total wall mass the explosion cushioning is higher as the inner wall may absorb energy and expand into the space without disrupting outer wall integrity. Yet the structure adds less to explosion confinement than a corresponding single wall mass. Shrapnel from the ignition device is dampened by the inner wall and stopped by the outer wall. Fragmentation of inner wall is similarly neutralized by the unaffected outer wall. The desired behavior can be amplified by selecting different materials in the walls, for example by using a harder and more brittle material in the inner wall, which also improves positioning of the ignition device, whereas a tougher and less easily shattered material may be employed in the outer wall. In spite of the improvments, the design is still simple and easily assembled with its ignition devices. In the preferred coaxial arrangement the parts can be axially threaded on each other and ignition devices of varying lengths can be accomodated. If desired, an additional inner space between the ignition device and the inner wall can be provided. Such a space improves dampening, facilitates adaption to varying ignition devices and can be used to accept secondary ignition devices such as fuses. For the latter purpose the fuses may be field-assembled by simple axial threading or radial placing, resulting in an efficient alignment adjacent the ignition device and supporting a sustained signal impulse to the fuses. The block is as tough against external damage as it is against internal shocks and space and inner wall prevents the ignition devices from being affected by any hit on the outer wall.

Further ejects and advantages with the invention will be evident from the detailed description below.

DETAILED DESCRIPTION

The block of the present invention may be used in connection with any pyrotechnic or explosive device for the purpose of avoiding the problems and achieving the advantages described hereinabove. The invention will be described mainly in connection with ignition and signalling devices for blasting networks where the described problems typicly appear. The primary ignition devices should be explosive in character, i. e. their action should at least in part rely on violent expansion, due to e.g. rapid combustion, deflagration or detonation, and often the devices are structurally destroyed in use. Typical representatives for this kind of ignition devices are detonating cords and detonators or caps. It may be of particular interest to use the present blocks in connection with devices which are not entirely consumed in their reaction but leaves solid residues, especially heavy or highly penetrative shatter, metal shrapnel in particular. Metal manteled detonating cords may be of this kind as may almost all kinds of detonators comprising metallic shells, explosives capsules, ignition charges confinements, pyrotechnic or electronic delay units, sealer elements, ignition units supports or capsules etc. Detonating cords are used as signalling lines and as means for direct ignition of similar cords or of low energy fuses. Detonators may be used as functional end devices on electrical conductors, low energy detonating cords or fuses or other signalling means unable to themselves explosively initiate other devices. The detonator may simply transmit the signal to one or several secondary cords or fuses or may perform other functions as well, such as controlling or delaying the signal to secondary lines.

The present block may be used for any of the purposes and devices described. The block may be used for fastening or aligning ignition devices, without adding to the destructive properties of the devices. It is preferred, however, to use the invention for blocks used to connect a primary ignition device to one or several secondary devices, to utilize the additional advantages described. It is further preferred to use the block in connection with the detonator type of primary ignition devices in view of the previous difficulties experienced. Preferably then, the incoming signalling line to the detonator is of non-explosive type. Similarly outgoing secondary lines are suitably of the low energy type, to limit overall system energy ouside the blocks, and low energy shock tube fuses in particular (e.g. Nonel, registered trade mark).

Primary ignition devices of the cord or detonator types are generally elongated structures of a substantially circular cross-section. The block will be described mainly in connection with such structures although it is obvious that the block may be adapted to other shapes as well.

The primary ignition device is arranged substantially centrally in the block and the inner wall substantially surrounds the ignition device. Although a single central ignition device is the normal choice, it is within the scope of the invention to have several ignition devices, for example in parallel or axially abutting relationship., The inner wall need not be radially homogeneous or have axially constant cross-section. For the primary purpose of accepting shrapnel parts from the ignition device the inner wall shall shield the ignition device in directions where ejection shall be prevented, and shall preferably surround the ignition device. For this shielding purpose it is not necessary that the wall is circumferentially continuous. A secondary purpose may be to absorb explosive shock and expansion. Although a discontinuous wall have some effect in this regard, it is preferred that the wall is tangentially coherent so that an inner expansion creates tangential tensile forces in the wall. The strength of the inner wall- against expansion should preferably be less than that required to entirely resist the explosive action of the ignition device under its normal operation and should preferably allow expansion of the inner wall up to the outer wall. It is not necessary but acceptable if the expansion also results in a shattering of the inner wall. These properties results in a consumption of explosive energy generated by the ignition device. Suitable strength properties can be affected by wall thickness or material selection. For a given material the artisan can easily modify wall thickness and design to reach the desired properties, for example by starting with a strong construction and reducing its strength until expansion or shattering occurs or by starting with a weak material and increasing the strength until expansion or shattering merely occurs. Through material selection the artisan can balance toughness against brittleness, the latter property preferably being sufficient to secure at least some fragmentation of the inner wall before impact on the outer wall. As a non-limiting indication, a wall thickness for plastic materials could be between 1 and 10 mm and especially between 1.5 and 5 mm. Considering the strong temperature dependence for material hardness and brittleness, experimentation should be made at roughly the intended operational temperature for the block. The axial extension of the inner wall is not critical insofar as it is sufficient to cover most of the explosive parts of the ignition device and the probable trajectory for shrapnel ejection. The inner wall may be generally cylindrical in design, but no symmetry requirements are mandatory. For profile type inner walls and ignition devices ending in the block an axial end wall may be provided at the ignition device output end, as an axial cushioning or physical stop for the ignition device.

The inner wall may be arranged snugly on the outer surface of the ignition device. This may be done to give a safe friction fit between ignition device and block or to allow detonator parts to be pressed directly into the inner-wall cavity and dispense with the normal detonator shell structure. In most applications it is preferred to provide a space between ignition device and inner wall for reasons outlined above. Spacers can be used to bridge the gap and secure the relationship between the parts. If the block is intended for connections against other devices, cords or fuses can with preference be placed within this compartment to receive the full power from the ignition device without limiting the protective properties of the block. These secondary lines are by preference placed or threaded axially through the space, for which purpose the space and any spacers present therein should leave axial channels of adapted size to the secondary lines, typicly of a width between 1 and 10 mm and in particular between 2 and 6 mm. Other ways of arranging the contact between ignition device and secondary lines are conceivable, however, such as placing the lines at the axial end of the block and ignition device, threading the lines through slots penetrating the block walls radially or obliquely etc.

The space substantially surrounding the inner wall shall prevent any shock wave or shrapnel from directly propagating to the outer wall and shall allow the inner wall to freely expand or rupture before impinging on the outer wall. The dimensions for the space may vary depending on the nature of inner wall material. A hard and brittle material, consuming energy by rapid fragmentation, requires a smaller space than a more resilient material, consuming energy by resisted expansion. As a general rule, the radial extension of the space should be at least equal to the radial extension of the inner wall and should be less than about ten times this extension. Preferably the space ranges between 1.5 and 5 times the inner wall extension. The space may operate as intended when filled with any material of substantially lower density than the inner wall material and may contain a filling of lightweight material such as expanded plastic, e.g. for the purpose of giving the block a higher overall strength or preventing foreign matter from penetrating into the space. In most applications, however, an empty space is preferred, although the space will act as an expansion chamber also if partially filled with spacers, fixtures or other structures.

The outer wall substantially surrounding the inner wall and the space should be designed to accept impact of parts from the ignition device and inner wall as well as remaining explosive energy from the ignition device, to the extent necessary to prevent any destructive effect on the surroundings. Accordingly the minimum requirement for outer wall strength is that any parts penetrating it or ejected from it have sufficiently low energy to be harmless. Preferably the wall is strong enough not to be shattered although it may be ruptured. Pieces of a ruptured wall may adhere at one axial end of the wall if the wall is long enough to extend the explosive parts of the ignition device and/or if the wall has special strength supports, for example at the intersecton of inner and outer walls. Most preferably the outer wall is sufficiently strong not to be substantially ruptured in operation. As for the inner wall, it is not necessary that the wall is in any way symmetrical but it is suitable that it has a coherent mantel surface to resist internal pressures. To prevent shattering of the outer shell it is desirable to select a tough and slightly resilient material, allowing some expansion before rupture, rather than a hard and brittle material. The material may be selected differently for different intended use temperatures. For a given material the artisan can easily give the wall the desired strength properties by routine experimentation, e.g. by increasing or decreasing wall thickness. As a non-limiting indication, a wall thickness for plastic mateials could be between 1 and 10 mm and especially between 1,5 and 5 mm.

Inner and outer walls may have any type of overall shape, such as spherical, rectangular etc. and may to some extent be adapted to the ignition device shape. Generally profiles of roughly constant cross-section are preferred for elongated ignition devices and also have practical advantages in manufacture, assembly and fuse connection. Inner and outer walls may be of different shapes, for example a cylindrical inner wall and a square cross-section outer wall profile, e.g. for connection purposes, although it is generally preferred that the walls are about congruent, cylindrical in particular. As said in connection with the inner wall, the axial extension should be sufficiant for encasing at least the active and ejective parts of the ignition device.

Inner an outer walls may be of the same material, e.g. in order to facilitate manufacture. As indicated it is preferred, however, to use different materials in the walls, which generally permits adapted properties, not only in respect of shock absorption but in view of fastening or other practical aspects as well. For reasons indicated above, a preferred adaption is to select a harder material in the inner wall and a more resilient material in the outer wall. A harder material in the inner wall broadly means a more precise and rigid fixation and orientation of ignition device and possible connections, a better final protection of the ignition device against external damage and a more rigid inner product in manufacture and assembly. A correspondingly higher disintegration tendency is neutralized by the outer wall. A more resilient material in the outer wall absorbs sharpnel and internal explosion with maintained integrity, resists external damage without breakage and adapts better at assembly and connection.

Inner and outer walls may be designed as separate parts of the block, preferably with a mechanical lock therebetween to allow separation. A standardized inner unit comprising the ignition device and the inner wall can then be manufactured in a primary step. The unit can be used as such in less demanding applications and can be assembled in a secondary step with various types of outer walls, for example of different materials for different temperatures or with different marking for different block properties, such as detonator strength or delay. Storekeeping is reduced and part manufacture facilitated.

It is within the scope of the invention to arrange additional interleaved layers of spaces and walls around the outer wall, such spaces and walls being designed as described herein for the unconditional space and outer wall, although all spaces and outer walls can be made correspondingly thinner in a multiple structure.

The block should include fixation means adapted to keep the parts in the desired relationship and optionally also for holding and orienting incoming signal conductors and for hooking up outgoing conductors. Spacers may span the space between inner and outer walls and a space between inner wall and ignition device if present. The spacers can be protrusions or ridges, preferably axial, on the walls, preferably on the interior side of the walls. Alternatively, or in addition, the fixation means my include an annular contact area between the parts, for example in the form of expansions on inner and/or outer walls spanning the space, and arranged at any or both axial ends of the walls, preferably at the end of the incoming signal to the block. A mechanical lock can with preference be designed at such a contact area. Fixation means for incoming conductors to the ignition device may include a neck portion or arms protruding from the inner wall towards the incoming conductor, suitably slightly flexible to permit insertion of the ignition device and locking by compression around the conductor, e.g. with a ring or the natural flexure of the parts.

In the preferred use of the block as a connector to one or more secondary signal conductors, the fixation means may include means to guide and secure the secondary conductors in signal transmission relationship to the ignition device. Although though conceivable to position the secondary conductors in the space, it is preferred to place the conductors immediately adjacent or abutting the ignition device for best signal transmission, for which purpose a space should be present between inner wall and ignition device. The space may consist of a specific number of channels or an annular ring for an undetermined number of conductors, preferably allowing a substantially parallel arrangement between ignition device and conductors. It is further advantageous to thread or place the secondary conductors through the block from the output end of the ignition device, whereby incoming and outgoing signals will have substantially the same direction. Accordingly, fixation means securing inserted conductors against withdrawal are preferably arranged at the signal input end of the block. If the conductor space or channels are narrow, a knot on the far end of the threaded conductor will prevent withdrawal. It is preferred, however, to provide special means on the block allowing conductor fixation to the block by folding or knotting, such as slots or ribs. A preferred structure is a ring arranged on, but standing free of, the outer wall surface, providing space for numerous conductors. If the distance between ring and outer wall is adapted to conductor size, friction alone will secure a conductor threaded therethrough. The fixation means may also include additional arrangements for facilitating insertion of the secondary conductors, particularly when the block is intended for ignition of a bunch of secondary conductors. Such additional arrangements may include means for avoiding threading and allowing lateral insertion of the secondary conductors. An axial slit or opening in the outer and/or inner wall may allow this function. If desired, the slits can be covered after insertion, for example by compression or natural closure flexure, by rotation or axial assembly of inner and outer walls, by use of a separate covering body or by extending the wall or walls in a spiralling pattern around the ignition device. Locking means may be provided on or over the openings or slits to make the wall tangentially coherent and able to take up tangential forces during expansion as described hereinabove. It is also possible to include means for opening the block to expose the inner space or channels adjacent the ignition device during placement of conductors therein and closure or locking means for the so connected block. Preferably the block is opended radially, e.g. along axial separations on inner and outer walls, whereby the locking means should be designed to reinstate wall strength after closure. Hinges may be provided for facilitating the movements.

Suitable materials for the block parts are plastics. Thermosetting plastics, such as phenolic resins, urea resins, polyurethane resins can be used for the parts requiring hard materials. Better are elastomeric materials such as rubbers based on styrene/butadiene etc. Thermoplastic materials are generally preferred for both inner and outer walls as being sufficiently strong, less brittle and requiring no curing steps. Polyamine is preferred when the requirements for strength are high and its hardness can be influenced by polymerization degree. Polyvinylchloride is cost effective and can be given varying hardness by softener additives. Most preferred are polyolefinic plastics such as polypropene and polyethene of which both hard and soft qualities are available, linear varieties generally being harder than branched. Good results have been obtained with HDPE for the inner wall and LDPE for the outer wall. General means of increasing the plastic material strength is include fibrous material such as glass fibers whereas hardness and brittleness can be obtained by inclusion of particulate fillers such as kaolin. The parts are preferably manufactured and shaped by molding the plastic materials.

DESCRIPTION OF DRAWINGS

Figure 1A:
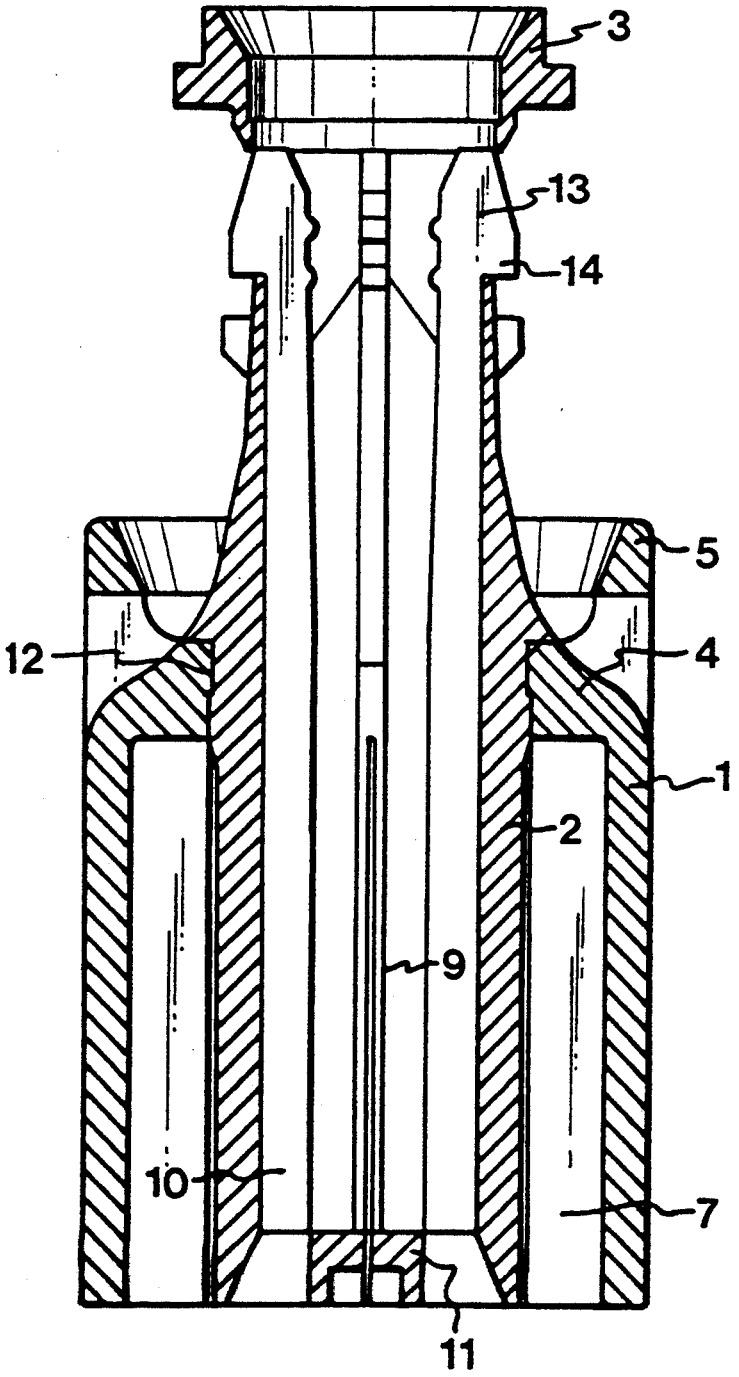
FIGS. 1A to 1E show in section and views one embodiment the block of the invention with generally concentric inner and outer walls.
Figure 1B:
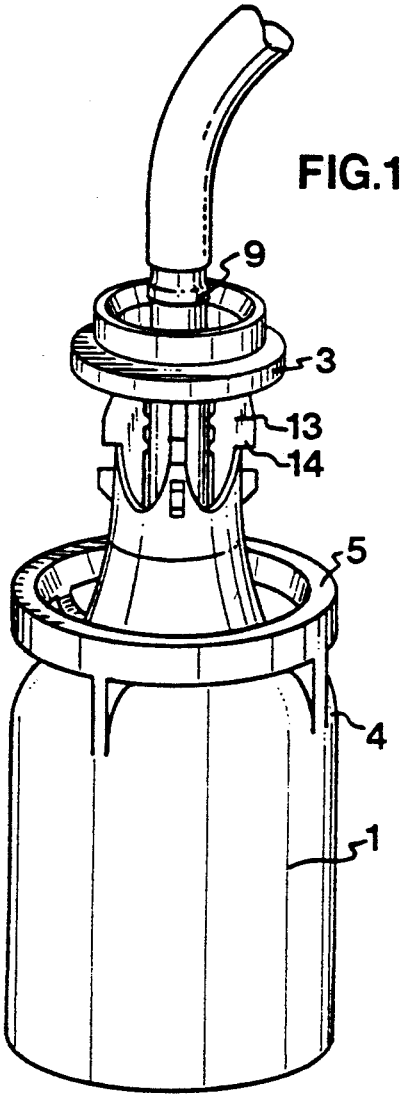
Figure 1C:
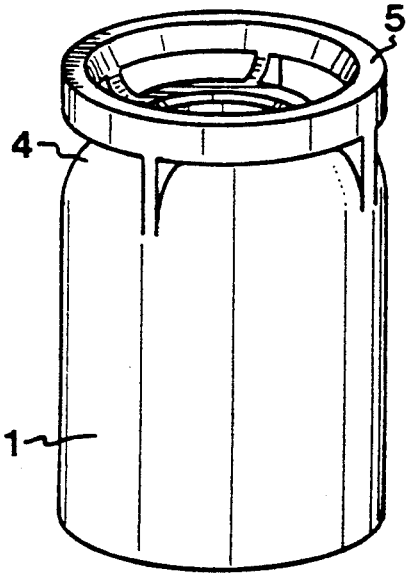
Figure 1D:
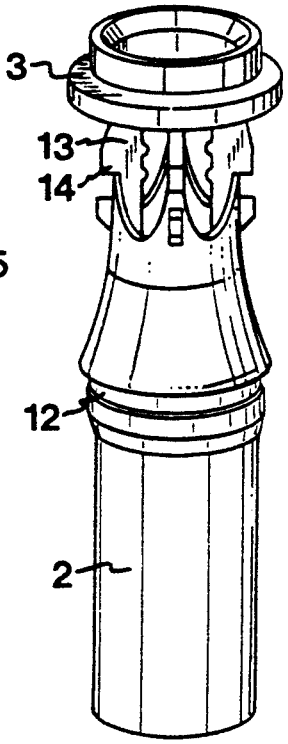
Figure 1E:
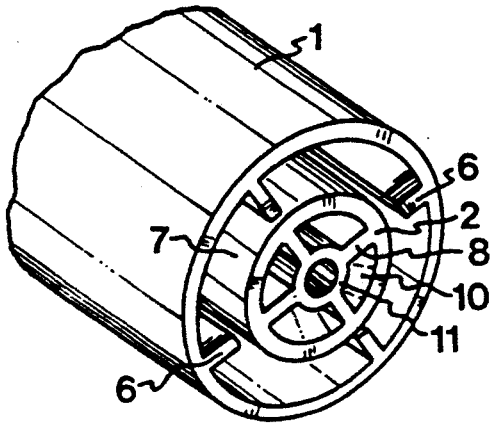

The block according to FIGS. 1A to 1E comprises three separate parts, a generally cylindrical outer wall 1, a generally cylindrical inner wall 2 and a locking ring 3. The outer wall 1 has a neck portion 4 leaving a circular opening adapted to receive the inner wall structure. A ring 5 standing above the neck portion 4 allow fuses threaded from the bottom of the block to be secured against withdrawal by knotting. As best seen in FIG. 1E, axial ridges 6 are arranged on the interior surface of outer wall 1, acting as spacers between outer and inner walls to provide a space 7 between these parts. As best seen in FIGS. 1D and 1E, the inner wall structure 2 similarly has axial ridges 8 on the interior side of its cylindrical part acting as spacers between the inner wall and a centrally disposed detonator 9 to provide a space 10 between these parts. An axial stop 11 for the detonator 9 is also arranged on the wall at the lower or output end of the block. At the upper or input end of the inner wall is provided a structure 12 adapted to lock in a releasable manner against the neck portion 4 of the outerr wall 1. Resilient arms 13 extends from the upper part of the inner wall 2. Their remote ends are arranged to be radially compressed behind the detonator 9 by use of the ring 3, which is then retained by undercuts 14 on the arms. The assembled unit as seen in FIG. 1B is obtained by inserting the detonator 9 between the arms 13 and pushing it between the ridges 8 until it abuts the axial stop 11 at the lower end of the inner wall 2. By use of ring 3 the arm 13 ends are compressed behind the detonator, from which the thinner signal conductors extend, to permanently retain the detonator in the inner wall structure 2. The outer wall structure 1 is pushed on the inner wall 2 until part 12 locks against neck 4. In use, fuses to be ignited by the detonator in the block are preferably threaded through the space 10 from the bottom of the block and the fuse ends emerging between the arms 13 may then be secured by threading under, or knotting around, ring structure 5.

Figure 2A:
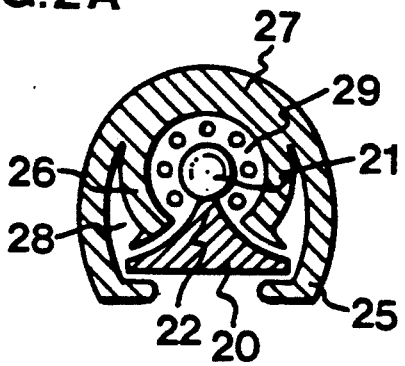
FIGS. 2A to 2C show show schematicly in views and section an alternative embodyment with assymetric wall parts.
Figure 2B:
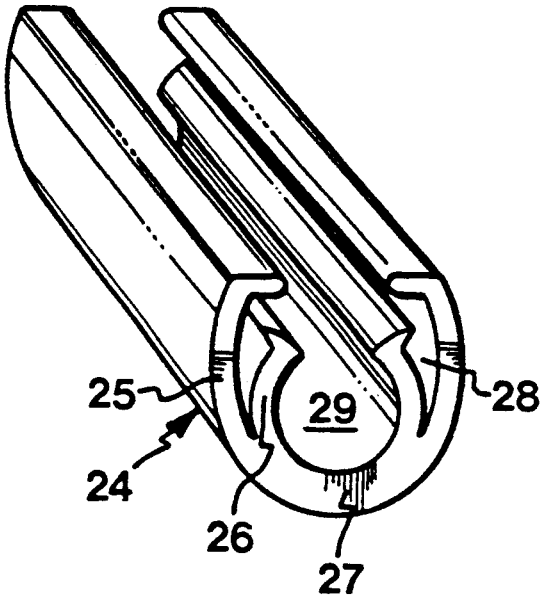
Figure 2C:
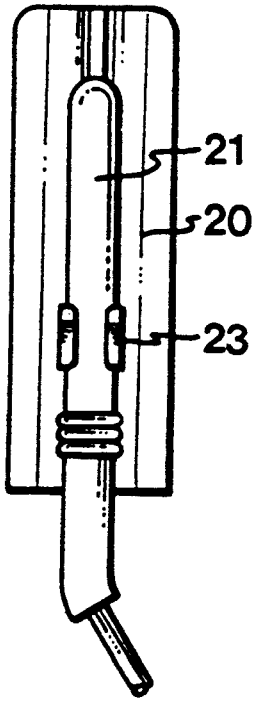

The block of FIGS. 2A to 2C comprises two parts. A slablike plate 20 has a detonator 21 mounted on a ridge 22 by use of holder 23. A trough-formed part 24 comprises an outer wall 25 and an inner wall 26, joined at the bottom 27 of the trough. Lateral spaces 28 are formed between inner and outer walls. A cavity 29 is formed within the bounds of inner wall 26. The free edges of the trough-formed outer wall overshoots the free edges of the inner wall to form therebetween opposed slits between which the plate 20 can be pushed and retained in such a manner that the detonator 21 becomes disposed centrally within cavity 29. Between inner wall 26 and detonator 21 a space is formed with a si--e adapted to receive one or several fuses to be ignited by the detonator. It is within the scope of the invention that outer wall 25 and inner wall 26 can themselves be designed as double-layers with an intermediate space, in accordance with the invention.

Figure 3A:
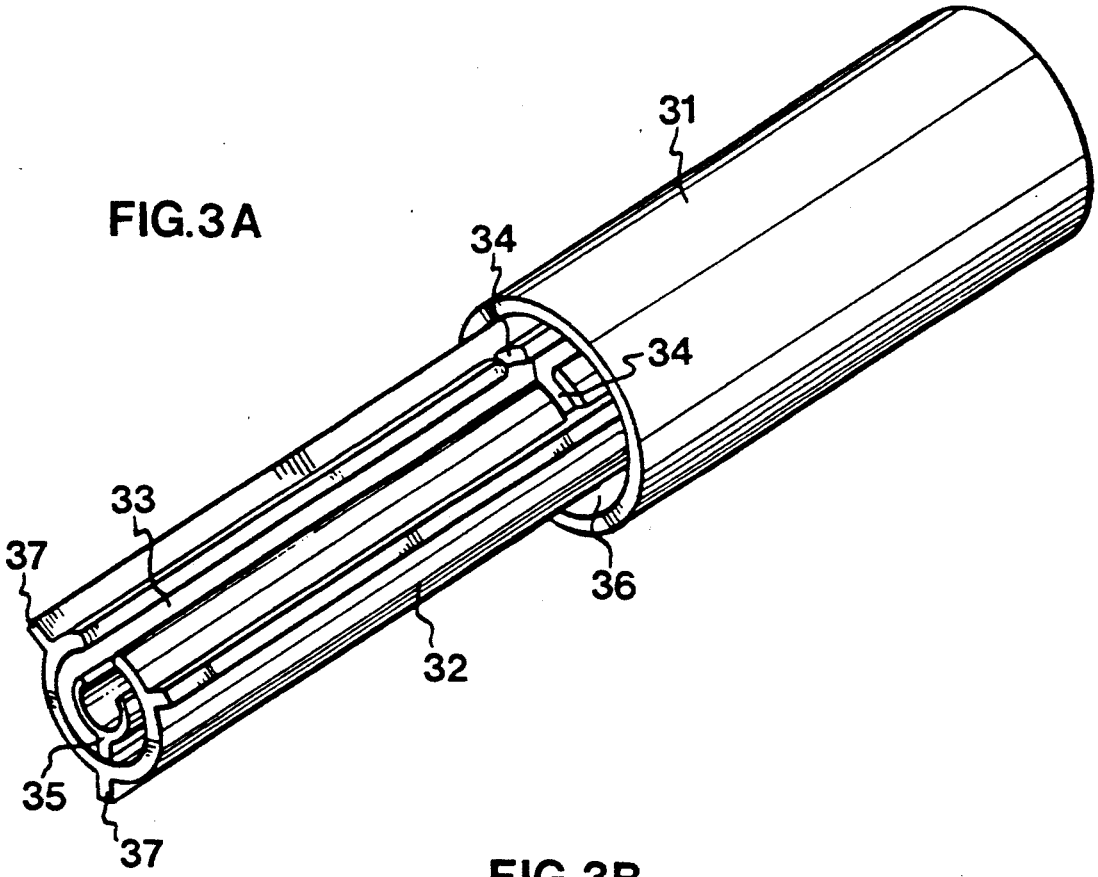
FIGS. 3A and 3B show schematicly in view and cross-section an embodyment with a slitted inner wall.
Figure 3B:
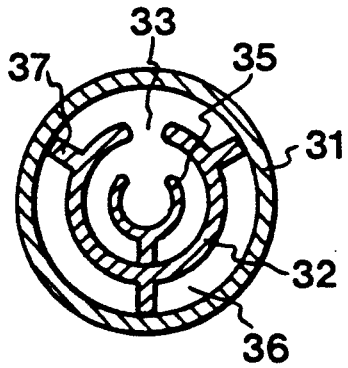

The block of FIG. 3 comprises an outer tubular wall 31 and a generally tubular inner wall 32 with an axial slit 33 in which one or several fuses may be placed and secured in the notch 34 in signal transmission relationship to a centrally disposed detonator retained in the holder 35. The inner wall unit is inserted into the outer wall 31, between which walls are formed a space 36 maintained by axial spacers 37 on the inner wall. It is within the scope of the invention that outer wall 31 and inner wall 32 are themselves double-layers having intermediate spaces.

Figure 4A:
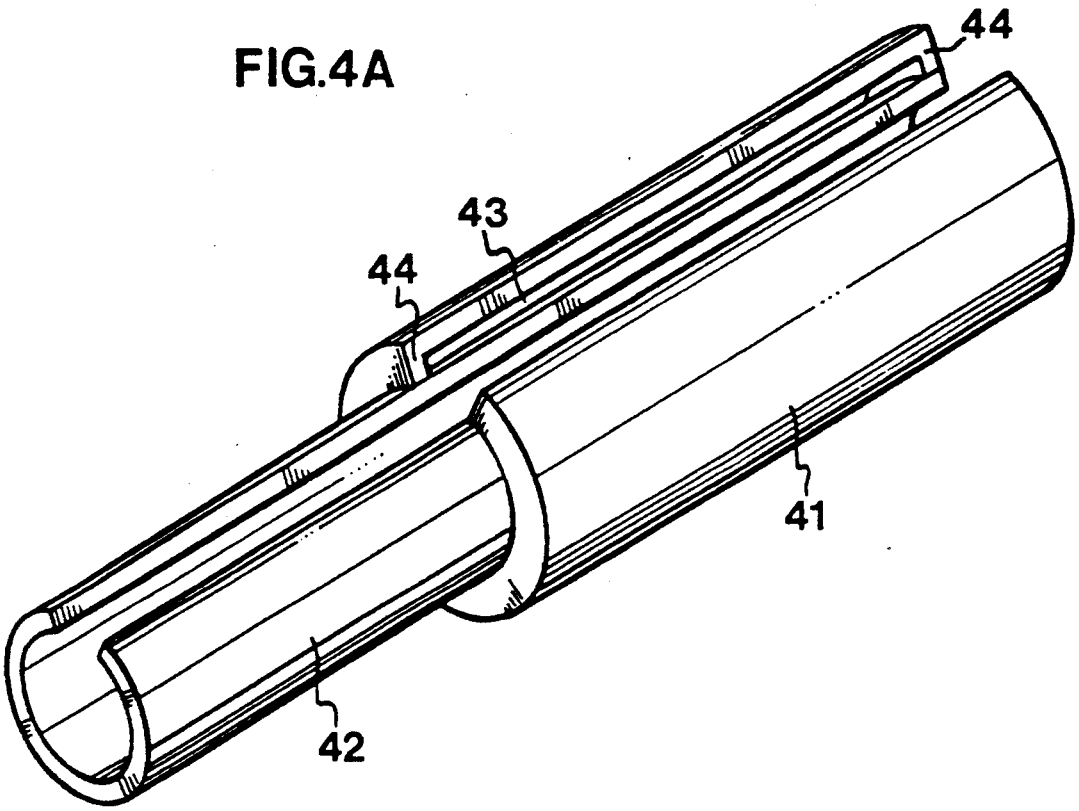
FIGS. 4A and 4B show schematicly in view and cross-section an embodyment with slitted inner and outer walls.
Figure 4B:
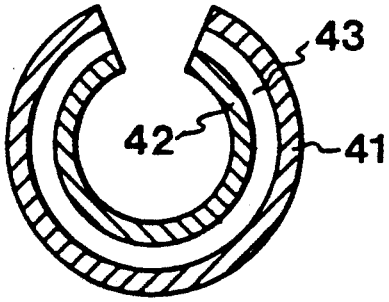

The block of FIG. 4 comprises a tubular axially slitted outer wall 41 and a tubular axially slitted inner wall 42. A detonator is centrally arranged in the inner wall 42. A space 43 is formed between inner and outer walls, maintained by radial spacers 44 on the outer wall end surfaces. Outer and inner walls may be reciprocally rotated. With coinciding slits, as shown in FIG. 4A, fuses may be laid down into the central cavity and the block may then be closed by rotation of the wall parts. The walls themselves may be double-layers with intermediate spaces.

Figure 5A:
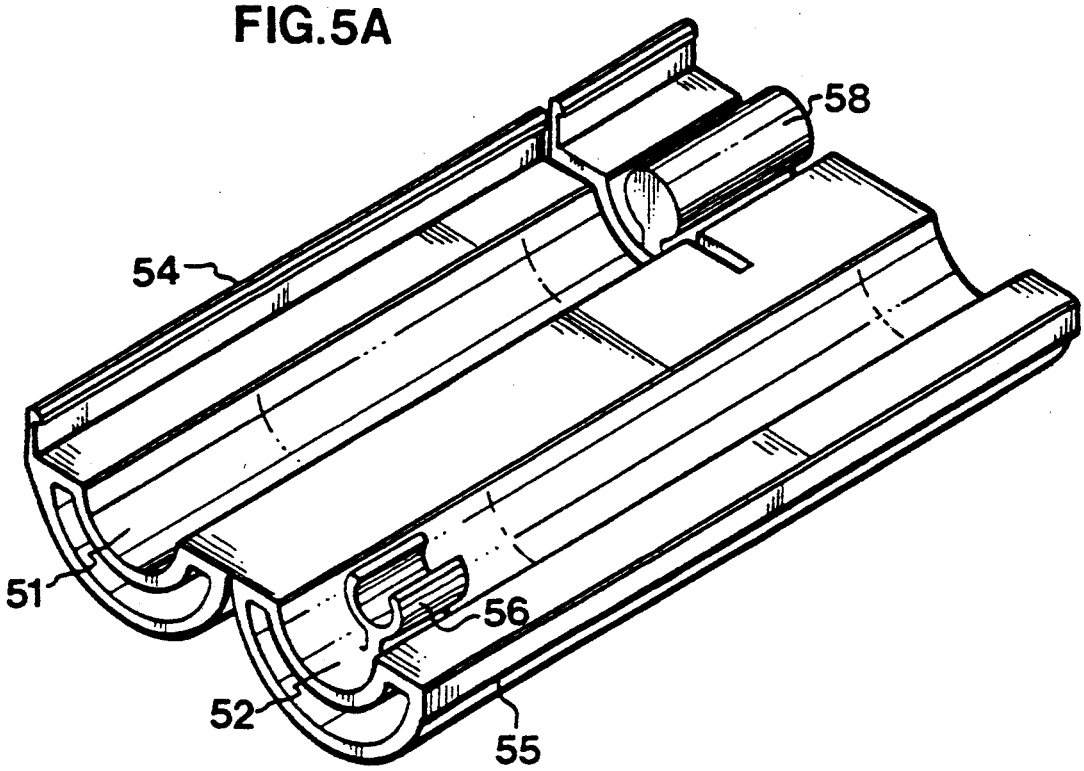
FIGS. 5A and 5B show schematicly in perspective and axial views an embodyment with axially sectioned inner and outer walls closable with a hinge and lock mechanism.
Figure 5B:
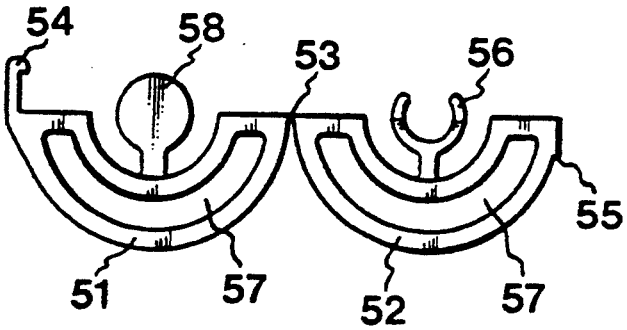

The block of FIG. 5 comprises two semi-tubular parts 51 and 52, which are axially joined at a plastic film hinge 53 allowing closure of the shown open block to a closed tubular structure. A locking mechanism, here comprising a resilient hook 54 on part 51 and a corresponding seat 55 on part 52. In the closed position the locking mechanism and the hinges secures a circumferential continuity in the block allowing it to take up expansion forces from the centrally disposed detonator placed in fixture 56. The wall parts 51 and 52 are constructed as double-layers with an intermediate spaces 57. In the open block position fuses are easily placed in contact with the detonator in the tube interior. When closing the block, the fuses are axially retained by slight compression between body 58 and the interior surface of the tube.

Figure 6A:
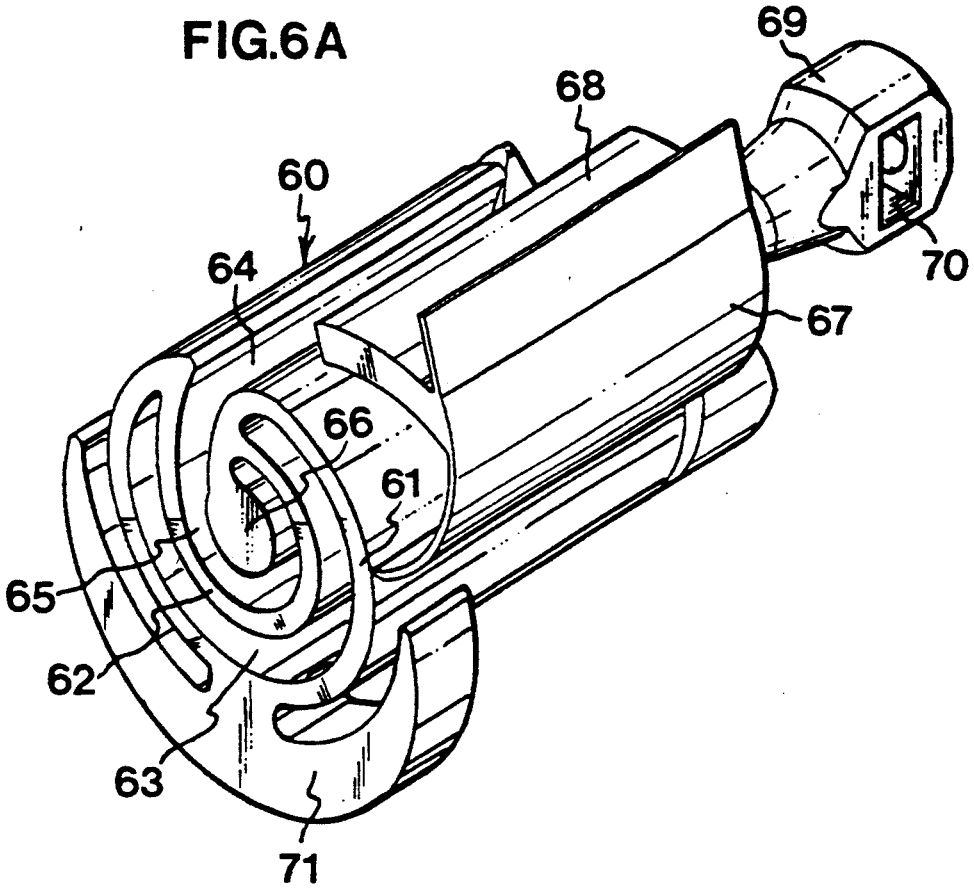
FIGS. 6A and 6B show in perspective and axial views an embodyment with spirally wound inner and outer walls.
Figure 6B:
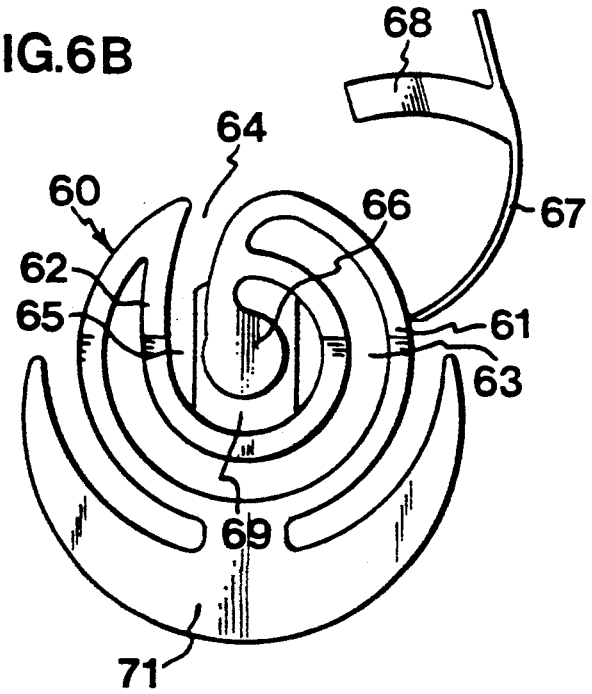

The block of FIG. 6 comprises a generally cylindrical double wall structure 60, comprising outer wall 61, inner wall 62 and an intermediate space 63. Inner and outer walls are axially joined along a slit 64 in the generally cylindrical double wall structure 60 and the inner wall 62 is given a spiral form to create an equally spirally wound cavity 65 around a central tubular compartment 66 for a detonator. A cover 67 can be rotated around a hinge to close the slit 64 wherby body 68 fills up the entrance parrt of spiral cavity 65. The detonator compartment 66 has a head portion 69 at its detonator receiving end with a hole 70 for insertion of a locking part (not shown) preventing axial withdrawal of the detonator. A yoke-like part 71 is provided for securing fuses connected to the block. In use, one or several fuses are laterally placed through slit 64 into the cavity 65 and the slit is closed by cover 67 whereby body 68 forces the fuses to the interior part of spiral cavity 65 where the fuses are in signal transmission relationship to the detonator in compartment 66. The fuses may be secured agains axial displacement by knotting around yoke 71 or by compression between the yoke and outer wall 61. Alterations can be made to the shown structure. The yoke 71, and the corresponding smaller yoke at the other axial end of the block, can be made as a separate part attached to the main part, in order to facilitate manufacture. The yoke arms can be privided with hooks to better retain the fuses. Body 68 and slit 64 can be provided with hooks and seats to retain the body and cover 67 when inserted into the slit. Head 69 can be attached either to the inner part of inner wall 62, like the compartment 66, or to the outer wall, the yoke or some other part at the block axial end, e.g. via supporting arms. The compartment 66 may can with preference embrace the detonator only partially in order not to dampen signal transmission to the fuses, e.g. by having openings in the neighborhood of the detonator base charge.

A practical advantage of the shown structure is the ease with which fuses can be connected to the block. Generally a slit allows lateral insertion of elongated signalling means into the inner space to avoid threading. The slit, however, also assists in smooth positioning of the means in safe signal transmission relationship to the ignition device. As the slit has, like the inner space, a width adapted to about the size of the signalling means, it e.g. secures that multiple signalling means are introduced in an orderly queue without jamming between the individual means or between means and walls. An especially smooth flow of the means is obtained in the shown embodyment with a spiralling inner wall since the slit entrance channel formed between two layers of the spiral here directrly continues in the annular inner space. The tangential connection between slit and inner space give a continuous channel for the signalling means, preventing any steep movement shifts for the fuses during insertion. The practical advantages here described are found in all embodyments shown with inner spaces and slitted inner walls, independent of the presense of the space and the outer wall outside the inner wall, and so designed blocks may be used in their own right, without the additional features, to obtain the advantages described.

We claim:

1. A block for holding an exploding pyrotechnic ignition device, comprising:
   - an ignition device;
   - an inner wall for substantially surrounding at least an axial part of the ignition device,
   - a space substantially surrounding the inner wall,
   - an outer wall substantially surrounding the inner wall and the space, and
   - fixation means for keeping the ignition device, the walls and the space in relative positions.

2. The block of claim 1, wherein the outer wall is made of a resilient plastic material, such as LDPE.

3. The block of claim 1, wherein the inner wall and the outer wall are made of different materials, the inner wall being of a harder material than the outer wall.

4. The block of claim 1, wherein the fixation means includes a snug fit between the ignition device and the inner wall.

5. The block of claim 1, wherein said space is at least partially filled with a material having a lower density than the inner wall.

6. The block of claim 1, wherein the fixation means include spacers in the form o protrusions or axial ridges between the outer wall and the inner wall.

7. The block of claim 1, wherein the block is axially divided into two joinable parts exposing an interior of the block.

8. The block of claim 1, wherein the inner wall is designed, in respect of dimensions and material, sufficiently weak to at least expand at normal operation of the ignition device.

9. The block of claim 8, wherein the inner wall is made of a hard plastic material such as HDPE.

10. The block of claim 1, wherein the space has a radial extension exceeding a radial extension of the inner wall and has a radial extension of 1.5 to 5 times the inner wall extension.

11. The block of claim 1, wherein the outer wall is designed, in respect of dimensions and material, sufficiently strong to resist total disintegration at normal operation of the ignition device.

12. The block of claim 1, wherein the fixation means include a radial restriction on the outer wall and a radial extension on the inner wall bridging the empty space and contacting and locking the inner and outer walls in a coaxial arrangement.

13. The block of claim 12, wherein the restriction and extension are designed as a mechanical lock allowing axial separation of the inner and outer walls.

14. The block of claim 1, wherein the outer wall and the inner wall each includes an axial slit to allow lateral insertion of a signalling means.

15. The block of claim 14, further comprising a cover arranged to close the slits.

16. The block of claim 15, wherein the cover comprises a body that fits in an entrance part of the slits.

17. The block of claim 14, wherein the outer and inner walls are slitted and that the walls can be reciprocally rotated to align and disalign the slits.

18. The block of claim 1, wherein the fixation means provides an annular inner space between the ignition device and the inner wall.

19. The block of claim 18, wherein the fixation means include opening means for exposing the inner space during connection.

20. The block of claim 18, wherein the fixation means include spacers in the form of protrusions or axial ridges between the inner wall and the ignition devices.

21. The block of claim 18, wherein the inner space is adapted in size to receive elongated pyrotechnical network signalling means, such as low energy fuses.

22. The block of claim 21 further comprising securing means for securing against withdrawal free ends of the pyrotechnical network signalling means.

23. The block of claim 22, wherein the securing means include a yoke arranged at an outer surface of the outer wall with a separation from the outer wall adapted to receive the pyrotechnical network signalling means.

24. A block for holding an exploding pyrotechnic ignition device comprising:

an ignition device;

an inner wall substantially surrounding at least an axial part of the ignition device, an annular inner space between the ignition device and the inner wall, and fixation means for keeping the ignition device, the inner wall and the annular inner space in relative positions, wherein the annular inner wall includes an axial slit.

25. The block of claim 24, wherein the slit is covered by insertion of the inner wall unit into a tubular outer wall.

26. The block of claim 24, wherein the slit in the inner wal! is covered by a tubular axially slitted outer wall and that the outer and inner walls are reciprocally rotatable.

27. The block of claim 24, wherein a space substantially surrounds the inner wall and an outer wall substantially surrounds the inner wall and the space.

28. The block of claim 27, wherein said space is at least partially filled with a material having a lower density than the inner wall.

29. The block of claim 24, further comprising a cover arranged to close the slit.

30. The block of claim 29, wherein the cover includes means for making the wall tangentially coherent and able to take up tangential forces during expansion.

31. The block of claim 29, wherein the cover comprises a body that fits in an entrance part of the slit.

32. The block of claim 31, wherein said cover body includes means for forcing a signalling means into an interior part of the inner space and in signal transmission relationship to the ignition device.

33. The block of claim 24, wherein the inner space is of a size sufficient to receive an elongated pyrotechnical network signalling means.

34. The block of claim 33, wherein the slit is of a size sufficient to allow lateral insertion of the signalling means.

35. The block of claim 34, wherein the slit is substantially narrower than a diameter of the annular inner space.

36. The block of claim 33, further comprising securing means for securing against withdrawal free ends of the pyrotechnical network signalling means.

37. The block of claim 36, wherein the securing means include a yoke arranged at an outer surface of the inner wall with a separation from the inner wall adapted to receive the pyrotechnical network signalling means.

38. The block of claim 24, wherein the inner wall is extended in a spiralling pattern around the ignition device.

39. The block of claim 38, further comprising a cover closing the slit and having means forcing a signalling means in the slit to an interior part of the inner space where the signalling means are in signal transmission relation ship to the ignition device.

40. The block of claim 38, wherein the spiralling inner wall defines the inner space as equally spirally wound around a central tubular compartment for the ignition device.

41. The block of claim 40, wherein the fixation means includes an attachment between the tubular compartment and an inner part of the spiralling outer wall.

42. The block of claim 40, wherein the compartment includes a head portion at its ignition device receiving end with locking means preventing axial withdrawal of the ignition device.

* * * * *